US011241606B2

(12) United States Patent
Williamson

(10) Patent No.: US 11,241,606 B2
(45) Date of Patent: Feb. 8, 2022

(54) APPARATUS FOR TEACHING THE FEEL OF SNOWBOARDING

(71) Applicant: Edward J. Williamson, Wanette, OK (US)

(72) Inventor: Edward J. Williamson, Wanette, OK (US)

( * ) Notice: Subject to any disclaimer, the term of this patent is extended or adjusted under 35 U.S.C. 154(b) by 183 days.

(21) Appl. No.: 16/565,934

(22) Filed: Sep. 10, 2019

(65) Prior Publication Data

US 2020/0001160 A1 Jan. 2, 2020

Related U.S. Application Data

(62) Division of application No. 14/869,390, filed on Sep. 29, 2015, now abandoned.

(60) Provisional application No. 62/057,771, filed on Sep. 30, 2014.

(51) Int. Cl.

| | |
|---|---|
| ***A63C 5/03*** | (2006.01) |
| ***A63B 69/00*** | (2006.01) |
| ***A63B 21/00*** | (2006.01) |
| *A63B 69/18* | (2006.01) |

(52) U.S. Cl.

CPC ..... *A63B 69/0093* (2013.01); *A63B 21/4011* (2015.10); *A63C 5/03* (2013.01); *A63B 2209/10* (2013.01); *A63B 2225/09* (2013.01); *A63C 2201/12* (2013.01)

(58) Field of Classification Search

CPC ..... A63B 69/0093; A63B 21/285; A63B 21/4011; A63B 2209/10; A63B 2225/09; A63C 5/03; A63C 5/16; A63C 2201/12

USPC ..... 434/253

See application file for complete search history.

(56) References Cited

U.S. PATENT DOCUMENTS

| | | | | |
|---|---|---|---|---|
| 2,754,121 A * | 7/1956 | Jupiter | ..... | A63H 3/02 434/250 |
| 6,592,377 B2 | 7/2003 | Bendele, Jr. | | |
| 2014/0272858 A1 * | 9/2014 | Fattori | ..... | A63B 69/18 434/253 |

OTHER PUBLICATIONS

"Michael Jackson 5 Act," Christopher, https://www.youtube.com/watch?v=M60cgjoq-6E&t=2s, Nov. 11, 2008 (Year: 2008).*

* cited by examiner

*Primary Examiner* — Jerry-Daryl Fletcher
*Assistant Examiner* — Jennifer L Korb
(74) *Attorney, Agent, or Firm* — Hall Estill Law Firm

(57) ABSTRACT

Method of using a snowboard training apparatus for transferring the feel of toe side and heel side of a snowboard from an instructor to a snowboard learner is disclosed. The training apparatus includes a training rod having a first and second end. The first end and second end of the training rod can be adapted to be supported by a snowboarder's leg, snowboarder's boot, snowboard's bindings or a snowboard itself. The training apparatus can also include a second training rod.

9 Claims, 6 Drawing Sheets

APPARATUS FOR TEACHING THE FEEL OF SNOWBOARDING

CROSS-REFERENCE TO RELATED APPLICATIONS

The present application is a divisional application of U.S. Ser. No. 14/869,390, filed Sep. 29, 2015, which is a conversion of U.S. Provisional Application having U.S. Ser. No. 62/057,771, filed Sep. 30, 2014, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a method of using a snowboard training apparatus for transferring the heel and toe feel of snowboarding from an experienced snow boarder to an inexperienced snow boarder.

2. Description of the Related Art

Traditionally, snowboarders taking lessons are told how to get the board on the heel side and the toe side and how that should feel. The inexperienced snowboarder can even be buckled into his boots and snowboard and be rocked back and forth by an instructor on a flat surface to try and give the snowboarder an idea of what the toe and heel feel will be when snowboarding down the mountain. Consequently, there is a need for a device or apparatus that can transfer the successful toe and heel feel of snowboarding while the learning snowboarder is snowboarding down the mountain.

SUMMARY OF THE DISCLOSURE

This disclosure is directed to method of using an apparatus that includes a training rod having a first and second end and a connection apparatus connected to the first end of the training rod. Further, the connection apparatus is adapted to be connected to a first user of a snowboard. The apparatus further includes a second connection apparatus connected to the second end of the training rod wherein the second connection apparatus is adapted to be connected to a second user of a second snowboard.

This disclosure is also directed toward an apparatus that includes a training rod having a first and second end. The apparatus also includes a first bracket connected to the first end of the training rod wherein the first bracket is adapted to be connected to a first snowboard and a second bracket connected to the second end of the training rod wherein the second bracket is adapted to be connected to a second snowboard.

DETAILED DESCRIPTION OF THE DISCLOSURE

Figure 1:
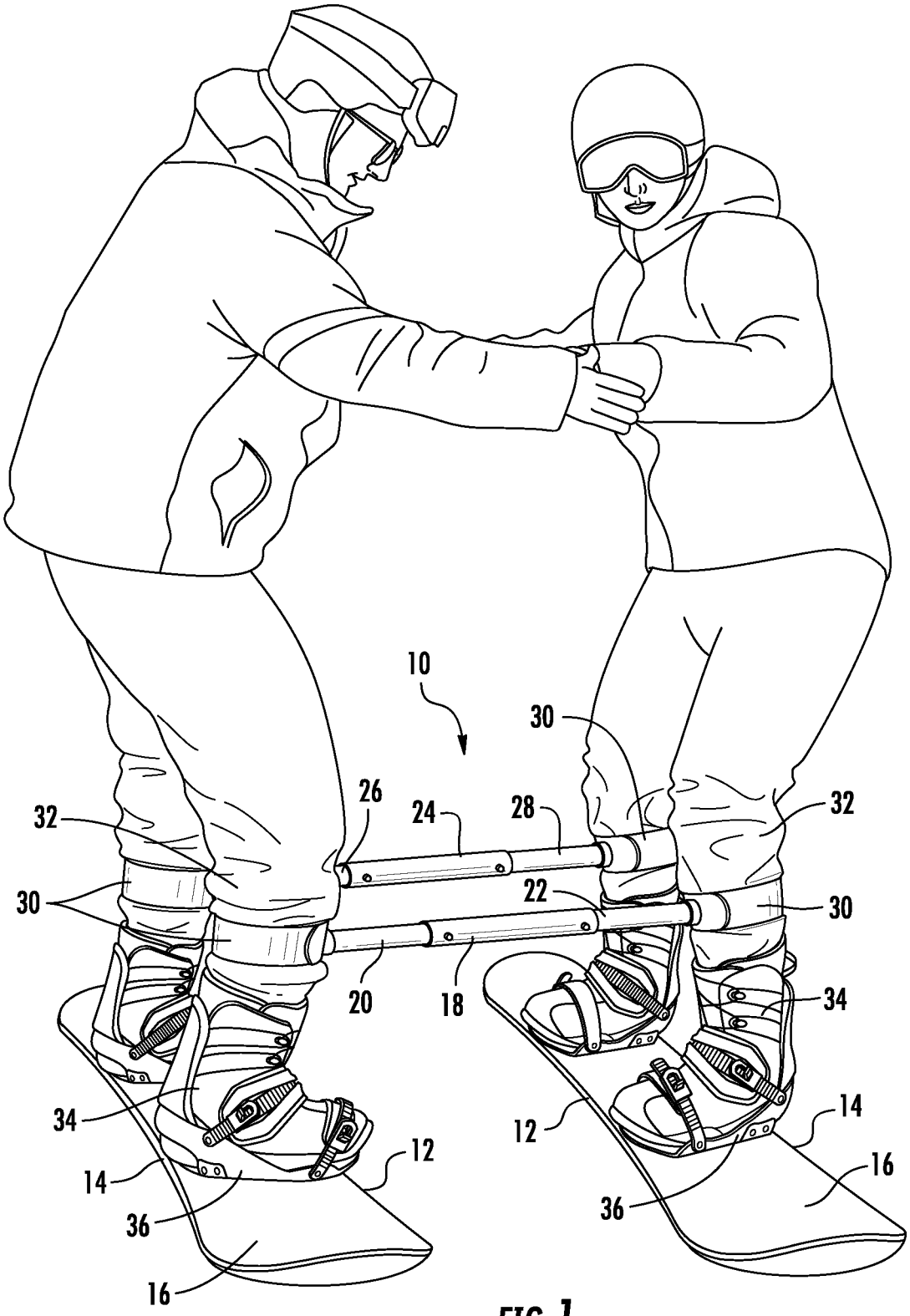
FIG. 1 is a perspective view of a snowboard training apparatus in use and constructed in accordance with the present disclosure.

Referring now to FIG. 1, the present disclosure relates to a snowboard training apparatus 10 for transferring the unique feel of being on a toe side 12 and a heel side 14 of a snowboard 16 from an instructor to a learning snowboarder. Generally, the snowboard training apparatus 10 includes at least one training rod 18 having a first end 20 and a second end 22. The first end 20 of the at least one training rod 18 can be supported by a first user of a snowboard or the snowboard of the first user and the second end 22 of the at least one training rod can be supported by a second user of a snowboard or the snowboard of the second user. The first and second user can be a snowboard instructor and a snowboard student.

In a further embodiment, the snowboard training apparatus 10 can include a second training rod 24 having a first end 26 and a second end 28. Similar to the first training rod 18 described herein, the first end 26 of the second training rod 24 can be supported by the first user of the snowboard or the snowboard of the first user and the second end 28 of the second training rod 24 can be supported by the second user of a snowboard or the snowboard of the second user.

The first ends 20, 26 of the training rods 18, 24 and the second ends 22, 28 of the training rods 18, 24 can be secured to the first and second users or the snowboards 16 of the first and second users via any manner known in the art. In one embodiment, the training rods 18, 24 can be secured to the first and second users via a brace 30 that can be attached to a leg 32 of each user. The brace 30 can be secured to the legs 32 of the first and/or second users in any manner known in the art and positioned on the first and second user such that the heel to toe movement of the snowboard instructor can be transferred to the snowboard student via the training rods 18, 24 and braces 30 attached to the first and second ends 20, 26 and/or 22, 28. The brace 30 can also be constructed of any material known in the art capable of being secured to the leg 32 of a user. Examples of materials include, but are not limited to, elastomeric materials, polymeric materials, and the like. The brace 30 can also include a fastening apparatus. The fastening apparatus can include, but is not limited to, Velcro® (hooks and loops), snaps, buttons, and the like.

The ends 20, 22, 26, and 28 of the training rods 18, 24 can be releasably secured to the brace 30 via any type of connection known in the art. Examples can include, but are not limited to, ball and socket type connections, hinged connections, and the like. The ends 20, 22, 26, and 28 of the training rods 18, 24 can also be connected to each brace where there is limited mobility at the connection.

As shown in FIG. 1, each brace 30 is adapted to be attached to each user's leg between the top of a snowboard boot 34 and below the knee. The brace 30 can be secured to the leg via a Velcro strap, buttons, hooks, adhesive material, stretchable sleeve, and the like. It should be understood and appreciated that the snowboard training apparatus 10 is adapted so that the snowboard instructor can be positioned in front of and facing the snowboard student or behind the snowboard student. Thus, the user in front can have the training rods training rods 18, 24 extending rearward from their body or forward and the user in back will have the training rods 18, 24 extending forward from their body.

Figure 2A:
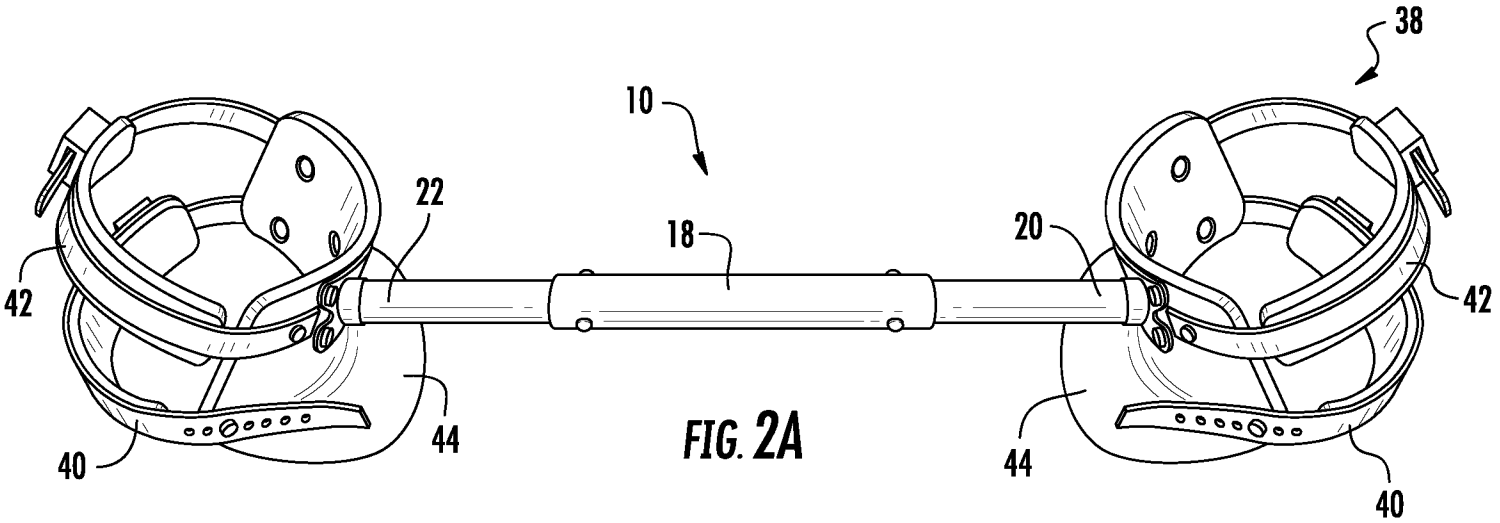
FIGS. 2A and 2B is are perspective views of another embodiment of the snowboard training apparatus constructed in accordance with the present disclosure.
Figure 2B:
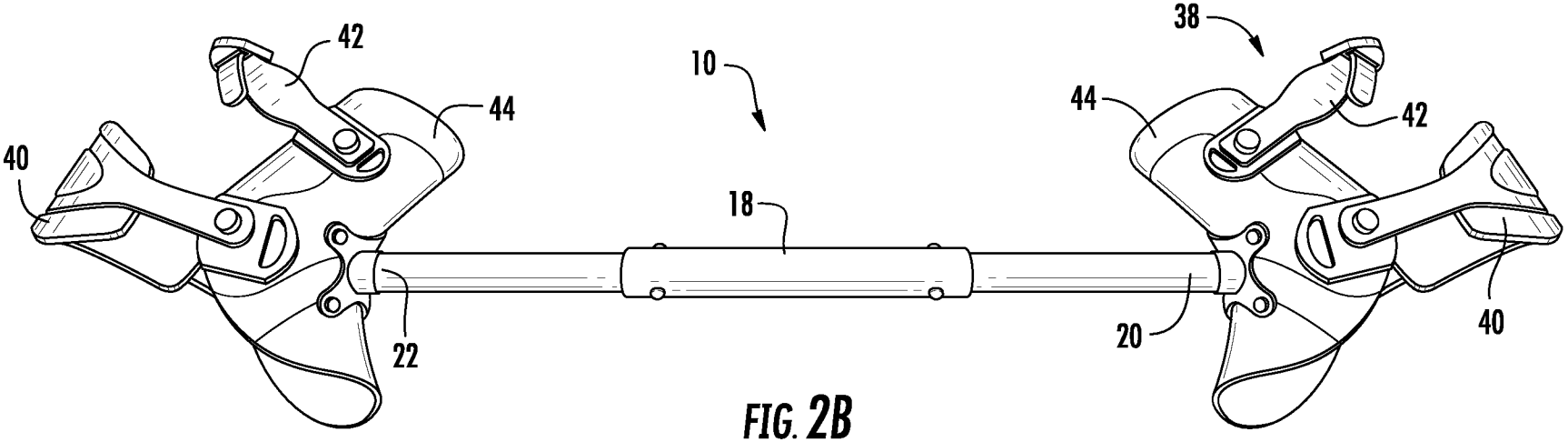
Figure 3:
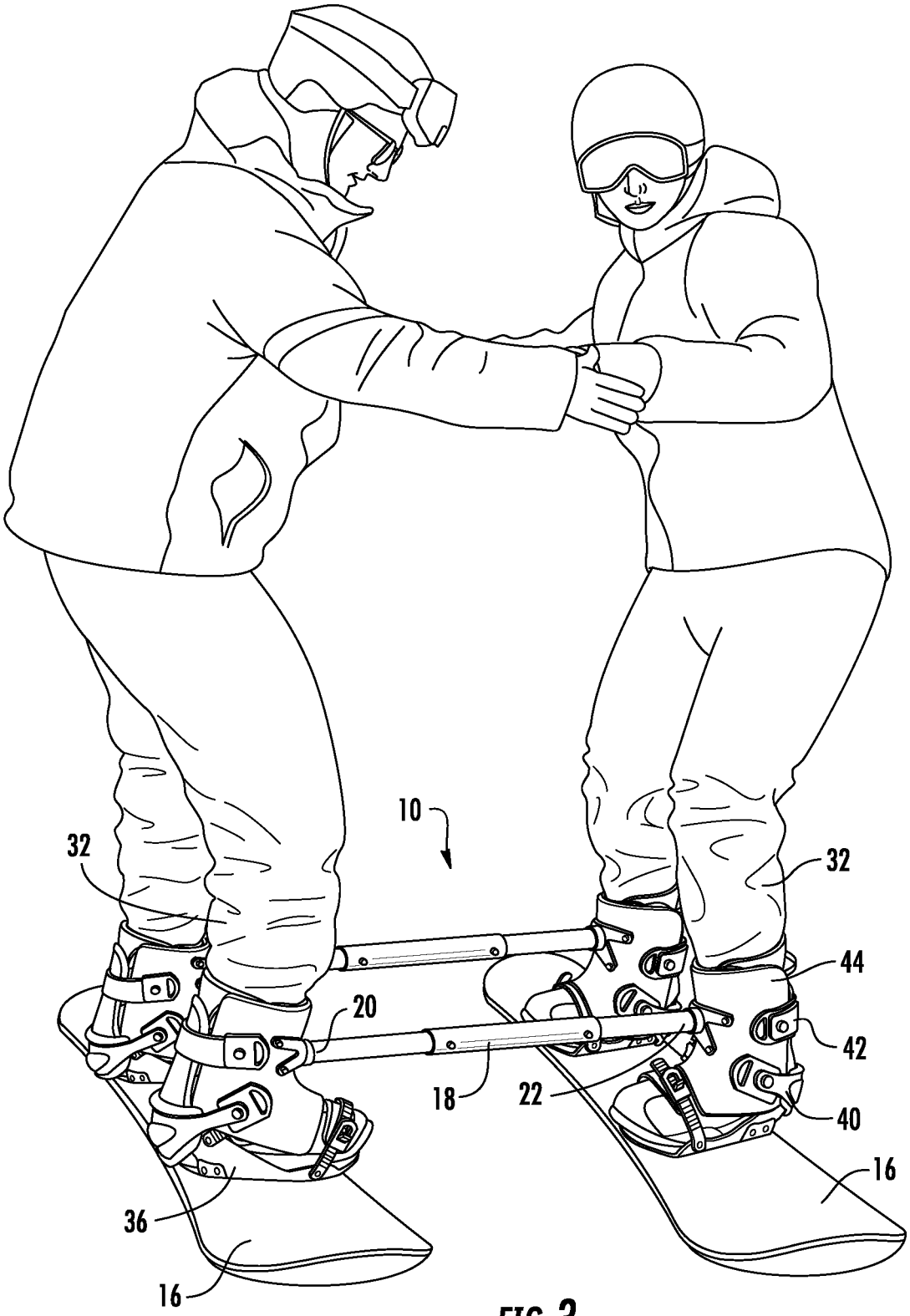
FIG. 3 is a perspective view of the snowboard training apparatus shown in FIGS. 2A and 2B in use and constructed in accordance with the present disclosure.
Figure 4:
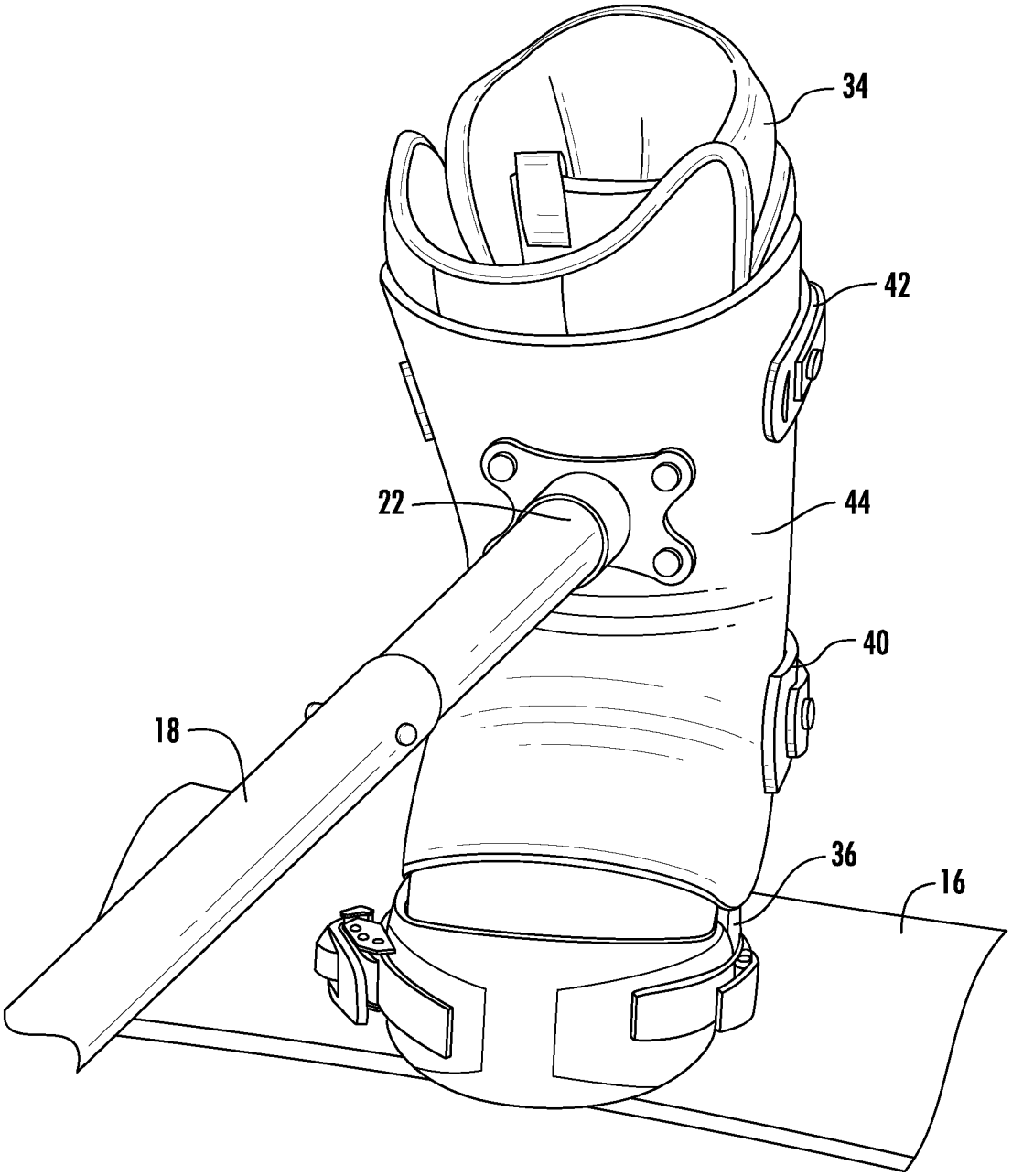
FIG. 4 is a close-up, perspective view of the snowboard training apparatus shown in FIG. 3 and constructed in accordance with the present disclosure.

In another embodiment, the ends 20, 22, 26, and 28 of the training rods 18, 24 can be supported by the snowboard boot 34 of the snowboard user, snowboard bindings 36, or the snowboard 16. Referring now to FIGS. 2-4, the ends 20, 22, 26, and 28 of the training rods 18, 24 van be releasably secured to the boots 34 via a connection device 38. The connection device 38 can be secured to the boots 34 in any manner known in the art. Similar to the training rod's 18, 24 interaction with the brace 30, each end 20, 22, 26, and 28 of the training rod 18, 24 can be connected to each boot 34 via a ball and socket type connection, a hinged connection, or where there is limited mobility at the connection.

In one embodiment, the connection device 38 includes a first strap 40 for securing each end 20, 22, 26, and 28 of the training rods 18, 24 to the boots 34. In another embodiment, the connection device 38 includes a second strap 42 for securing each end 20, 22, 26, and 28 of the training rods 18, 24 to the boots 34. The connection device 38 can also include a base portion 44 to provide a transition from the ends 20, 22, 26, and 28 of the training rods 18, 24 to the straps 40 and 42. The base portion 44 of the connection device 38 can have any shape and size such that it can be supported against the boot 34. In one embodiment, the base portion 44 of the connection device 38 can be shaped to fit the contour of the boot 34 as it transitions from the top of a snowboarder's foot, to a snowboarder's ankle and to a snowboarder's lower shin. The straps 40, 42 can be any type of strap that can be securely fastened to the boots 34. Examples of ways the securing of straps 40, 42 can be fastened around the boots 34 include, but are not limited to, Velcro® (hooks and loops), ratchet straps, buttons, buttons, and/or a combination thereof.

Figure 5:
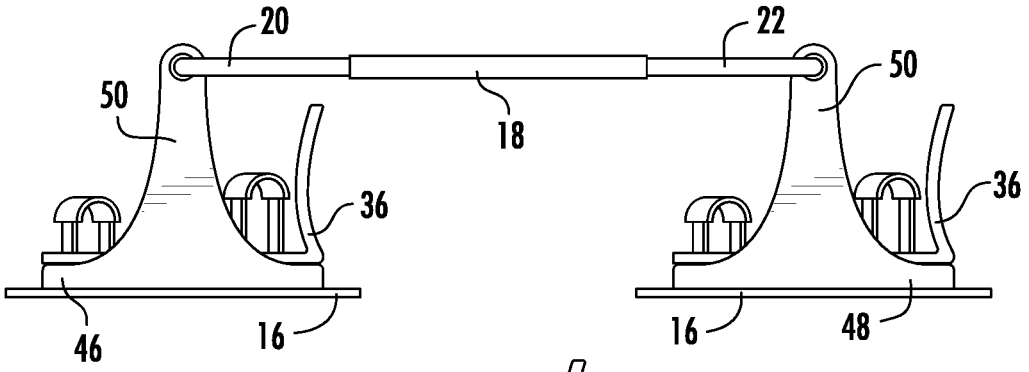
FIG. 5 is a side-elevation view of another embodiment of a snowboard training apparatus constructed in accordance with the present disclosure.
Figure 6:
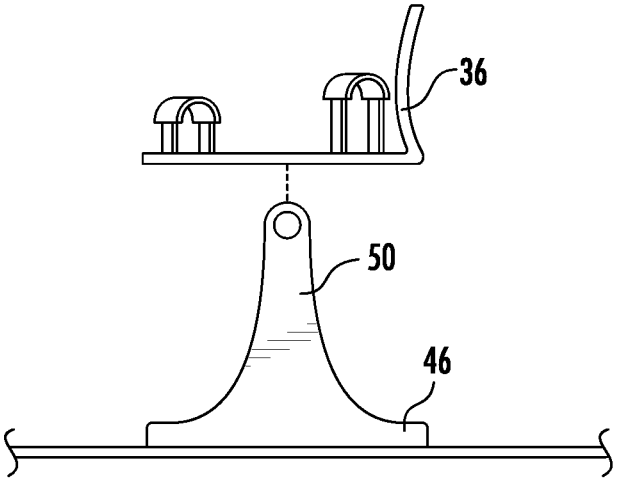
FIG. 6 is an exploded, side elevation view of the snowboard training apparatus shown in FIG. 5 constructed in accordance with the present disclosure.
Figure 7:
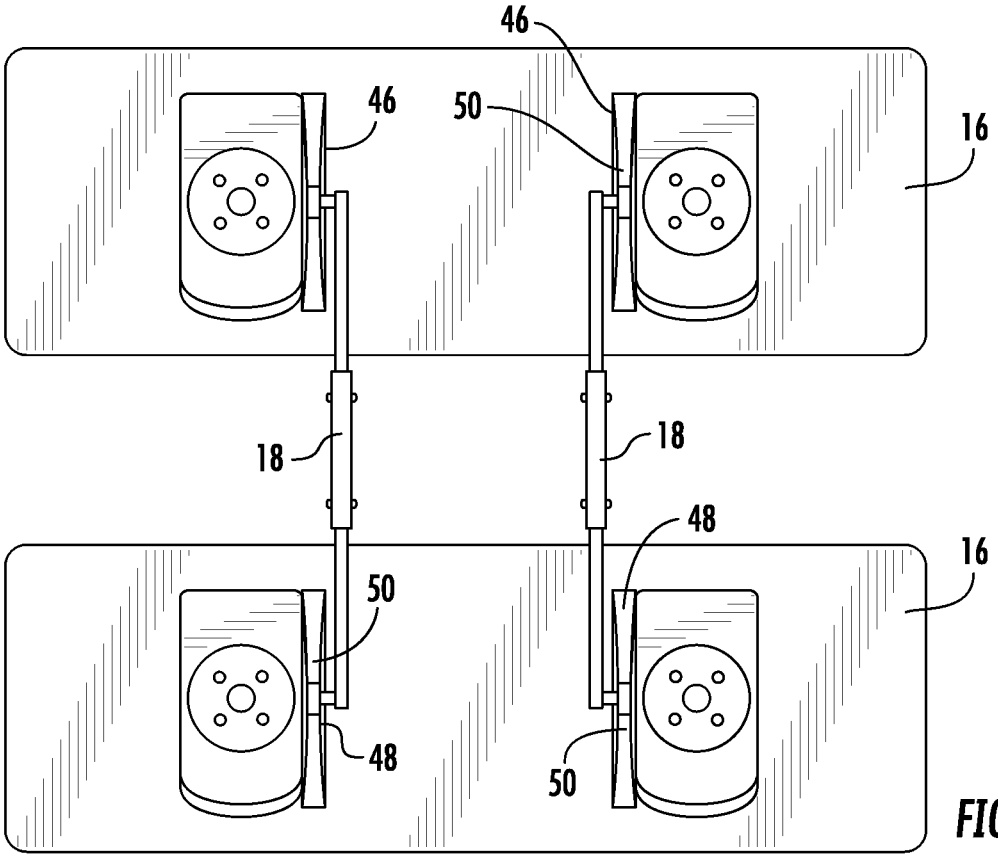
FIG. 7 is a top plan view of multiple snowboard training apparatuses shown in FIGS. 5 and 6 attached to a snowboard and constructed in accordance with the present disclosure.

In another embodiment of the present disclosure shown in FIGS. 5-7, a first bracket 46 can be attached to a first snowboard 16 and a second bracket 48 can be attached to a second snowboard 16. The brackets 46 and 48 can be attached to the snowboards 16 between the snowboards 16 and the bindings 36. In one embodiment, the first snowboard 16 includes two first brackets 46 and the second snowboard 16 includes two second brackets 48. Each bracket 46 and 48 can be adapted to be secured to the ends 20, 22, 26, and 28 of the training rods 18, 24. Each end 20, 22, 26, and 28 of the training rods 18, 24 can be releasably secured to the brackets 46 and 48 via various types of connections known in the art. In another embodiment, each bracket includes an extension element 50 that extends from the brackets 46, 46 away from the snowboard 16 to provide a more convenient place for connection to the ends 20, 22, 26, and 28 of the training rods 18, 24. The connection of the brackets 46, 48 to the ends 20, 22, 26, and 28 of the training rods 18, 24 can be rigid or allow for certain movement therebetween, such as rotational or hinged.

Figure 8:
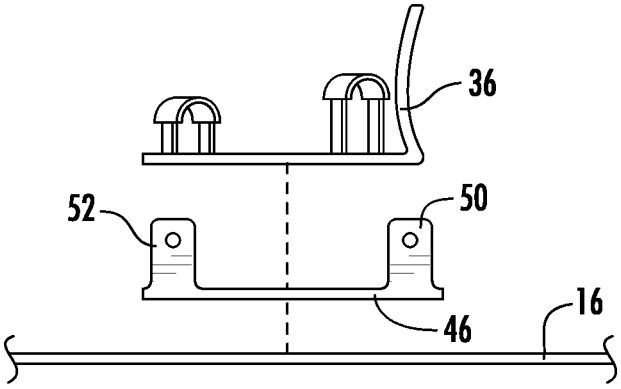
FIG. 8 is an exploded, side elevation view of another embodiment of a snowboard training apparatus shown constructed in accordance with the present disclosure.
Figure 9:
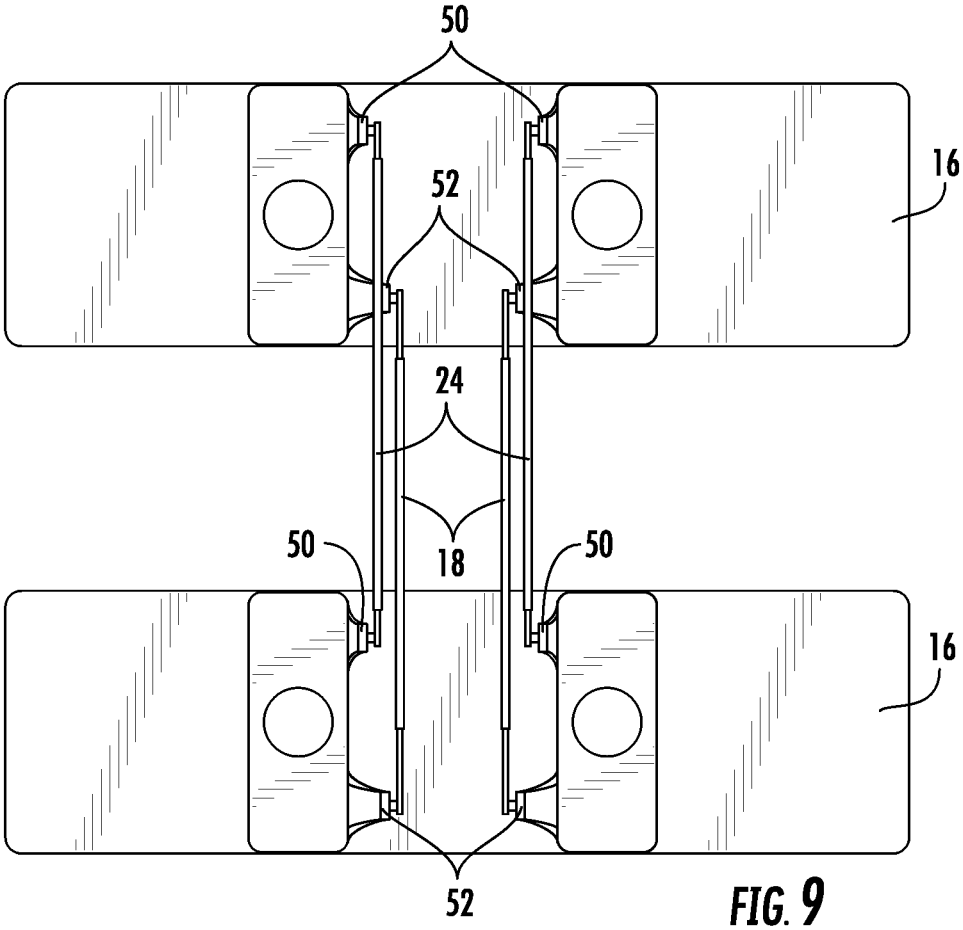
FIG. 9 is a top plan view of multiple snowboard training apparatuses shown in FIG. 8 attached to a snowboard and constructed in accordance with the present disclosure.

In a further embodiment of the present disclosure shown in FIGS. 8-9, the brackets 46 and 48 can include a second extension element 52 that can be used to implement additional training rods in the snowboard training apparatus 10. It should be understood that four training rods could be implemented in this embodiment to connect extension elements 50 to extension elements 50 at each binding location where brackets 46 and 48 are incorporated. Furthermore, second extension elements 52 can be connected by a training rod to second extension elements 52 at each binding location where brackets 46 and 48 are used. The extension elements 50 and 52 can be offset from each other or of differing heights so that the training rods would not contact each other or be in the way.

Figure 10:
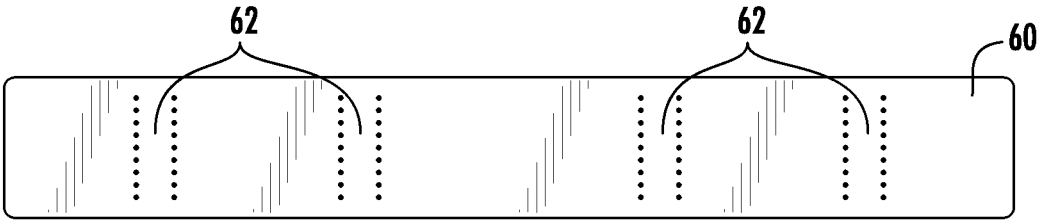
FIG. 10 is a top plan view of another embodiment of a snowboard training apparatus shown constructed in accordance with the present disclosure.

In yet another embodiment of the present disclosure shown in FIG. 10, an oversized snowboard 60 (sued for instruction) includes four bindings 62 disposed on the oversized snowboard 60. Two of the bindings 62 are for an instructor to be mounted into and the other two bindings 62 for the snowboard student learning how to snowboard. The oversized snowboard 60 can include a binding track integrated therein to strengthen the bindings connection to the snowboard and to facilitate movement of the bindings on the snowboard.

The training rods 18, 24 disclosed herein can include some type of quick disconnect such that if certain forces, torques, etc. are placed on the training rods, the users would no longer be connected by the training rods 18, 24. The quick disconnect can be located any place on the training rods 18, 24. Additionally, the training rods 18, 24 can be extendable and retractable to desired lengths desired by the users.

From the above description, it is clear that the present disclosure is well adapted to carry out the objectives and to attain the advantages mentioned herein as well as those inherent in the disclosure. While presently disclosed embodiments have been described, it will be understood that numerous changes may be made which will readily suggest themselves to those skilled in the art and which are accomplished within the spirit of the disclosure.

What is claimed is:

1. A method of teaching a person to snowboard using a snowboard training apparatus, the method comprising:

securing a first connection apparatus of a first snowboard training apparatus to a first leg of a first user of a first snowboard, the first user being a snowboard student;

securing a second connection apparatus of the first snowboard training apparatus to a first leg of a second user of a second snowboard, the first and second connection apparatuses connected by a first training rod having a first end and a second end, the second user being a snowboard instructor; and transferring heel to toe movement of the snowboard instructor from the second snowboard to the first snowboard of the snowboard student via the first snowboard training apparatus while the snowboard student is snowboarding down a mountain on the first snowboard.

2. The method of claim 1 further comprising:

securing a third connection apparatus of a second snowboard training apparatus to a second leg of the first user of the first snowboard; and securing a fourth connection apparatus of the second snowboard training apparatus to a second leg of the second user of the second snowboard, the third and fourth connection apparatuses of the second snowboard training apparatus connected by a second training rod having a first end and a second end.

3. The method of claim 2 wherein the first, second, third or fourth connection apparatus is a brace that is supported and attachable to each user's legs.

4. The method of claim 3 wherein the braces are supported and attachable above each user's boots and below each user's knees.

5. The method of claim 4 wherein the first and second user can be facing each other or one user is behind the other user.

6. The method of claim 2 wherein each training rod is extendable and retractable.

7. The method of claim 2 wherein the first leg of the first user is a right leg and the first leg of the second user is a right leg.

8. The method of claim 2 wherein the first leg of the first user is a left leg and the first leg of the second user is a right leg.

9. The method of claim 1 further comprising transferring heel to toe movement from the first user of the first snowboard to the second user of the second snowboard.

* * * * *